US006207196B1

(12) United States Patent
Rigal et al.

(10) Patent No.: US 6,207,196 B1
(45) Date of Patent: Mar. 27, 2001

(54) VEGETABLE BASE MATERIAL FROM CEREAL PLANTS AND PROCESS FOR OBTAINING THE SAME

(75) Inventors: Luc Rigal, Saint-Jean; Eric Peyrat, Toulouse; Vincent Pluquet, Madiran; Antoine Gaset, Toulouse, all of (FR)

(73) Assignee: Societe Cooperative Agricole Vivadour, Riscle (FR)

( * ) Notice: Subject to any disclaimer, the term of this patent is extended or adjusted under 35 U.S.C. 154(b) by 0 days.

(21) Appl. No.: 09/405,166

(22) Filed: Sep. 24, 1999

(30) Foreign Application Priority Data

Sep. 24, 1998 (FR) ..... 98 11966

(51) Int. Cl.[7] ..... A61K 9/16; A61K 9/36

(52) U.S. Cl. ..... 424/489; 424/499

(58) Field of Search ..... 424/195.1, 499, 424/494, 490, 461, 480, 489; 241/24, 48, 51, 74, 86.1, 5, 49; 514/781

(56) References Cited

U.S. PATENT DOCUMENTS 3,771,294 * 11/1973 Ronning ..... 55/345

* cited by examiner

*Primary Examiner*—Jon P. Weber
*Assistant Examiner*—Patricia A Patten
(74) *Attorney, Agent, or Firm*—Young & Thompson

(57) ABSTRACT

A material formed from plant matter granules has the following size distribution, the percentages being expressed by weight of dry matter: between about 5 and 50% of the granules having a size of less than about 0.25 mm, between about 5 and 40% of the granules having a size of between about 0.25 and 0.5 mm, between about 15 and 60% of the granules having a size of between about 0.5 and 1 mm, between about 1 and 10% of the granules having a size of between about 1 and 1.25 mm, between about 0.5 and 7% of the granules having a size of between about 1.25 and 1.4 mm, between about 1 and 10% of the granules having a size of between about 1.4 and 1.7 mm, between about 0.1 and 10% of the granules having a size of between about 1.7 and 2.36 mm, and between about 0 and 10% of the granules having a size greater than about 2.36 mm.

5 Claims, 1 Drawing Sheet

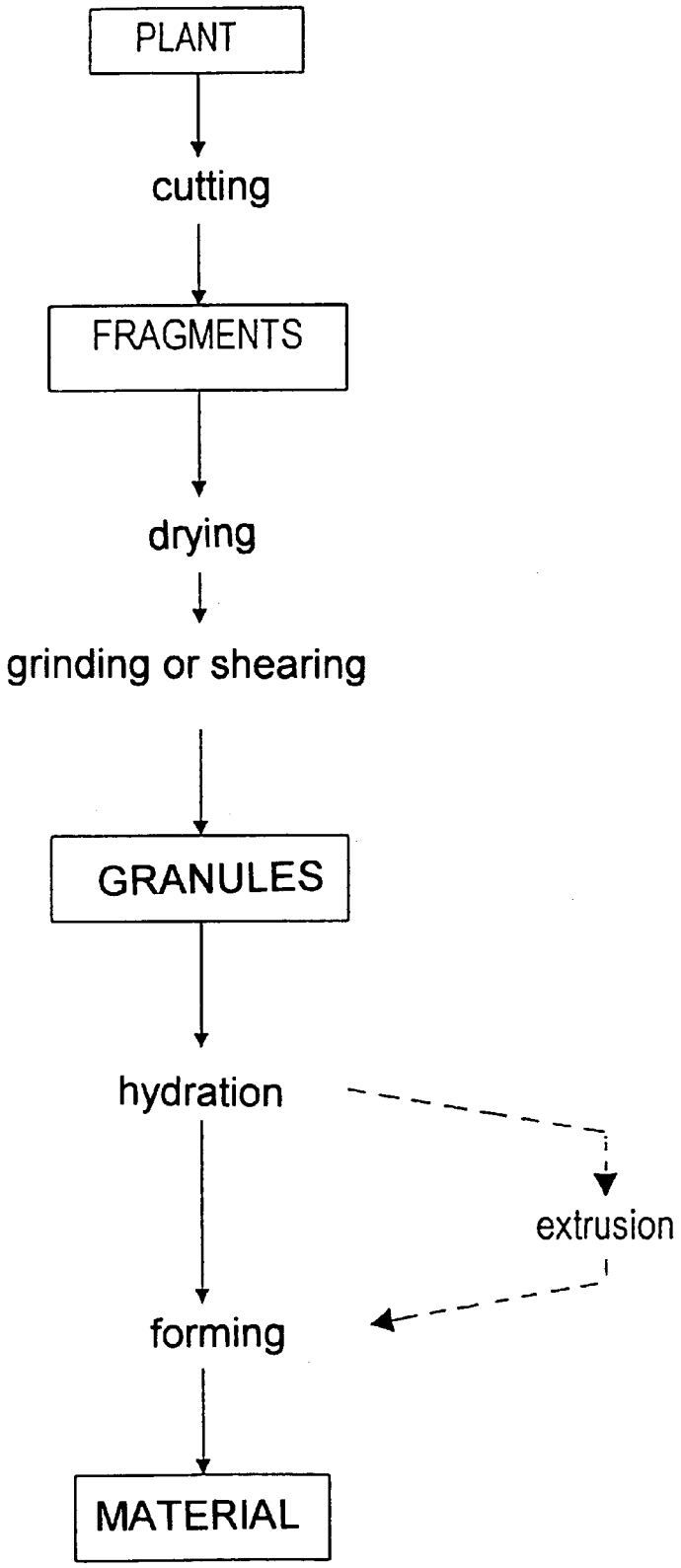
FIGURE

VEGETABLE BASE MATERIAL FROM CEREAL PLANTS AND PROCESS FOR OBTAINING THE SAME

FIELD OF THE INVENTION

The present invention relates to a plant-based material derived from the above-ground parts of cereal plants or from major fractions of these.

It also relates to a process for preparing such material.

BACKGROUND OF THE INVENTION

In recent years, there has been considerable development in biomaterials, mainly for ecological reasons.

In general, these materials are either materials reconstituted from products isolated from plants, or products isolated from plants mixed with synthetic materials, such as polymers. A commercially available product composed of a combination of a synthetic biopolymer and wheat, corn or potato starch, is an example of a material in this latter category. Several polymers may be combined with starch, such as polyvinyl chloride, polyethylene or polyvinyl alcohol.

In the first category are materials obtained by combination of starch with plant fibers.

However, these products have limited mechanical properties and are often sensitive to water.

U.S. Pat. No. 5,683,772 discloses compositions, which may be used as packaging materials, containing a starch-based binder, an inorganic filler, and fibers dispersed uniformly in the starch matrix. These fibers may include cellulose fibers, and may be obtained from leaves, stems, or other parts of the plant.

However, these fibers, and the starch, must necessarily be isolated, which considerably increases the manufacturing costs.

Application WO 95/04 111 discloses articles composed of a material containing wood particles impregnated with acid resin and a binder, which may be starch and/or proteins. In this material, the wood particles must necessarily be impregnated with resins and plant oils or fats.

U.S. Pat. No. 5,160,368 relates to a process for manufacturing packaging materials, comprising the production of a paste by heating a flour, from a graminaceous plant. This paste is mixed with crushed hay.

This process necessarily requires the production of the flour from the graminaceous plant, then its cooking, before admixture with the hay. There is thus no direct mixing of the grain and the hay.

It thus emerges from the state of the art that there is no known process for producing coherent materials from raw plant matter, in other words from plant matter not having been subjected to separation, or isolation of its different components.

One of the problems posed to a person skilled in the art lies in the heterogeneity of the components within a single plant tissue, and even more between two different tissues. In fact, in a whole cereal plant, the fibers have very different characters according to the part of the plant, both in their composition and shape. Thus, fibers of wheat straw or of the outer part of the stems and leaves of corn are long fibers, rich in cellulose (40–45% of dry matter), relatively ligneous (15% of dry matter), the remainder being composed of hemicelluloses, of xylan type structure. The fibers of corn bran or wheat bran (grain coating) are very different, being short, elastic, much richer in hemicelluloses (up to 60% of dry matter of the fibers against 15% of cellulose and 8% of lignin). In addition, these hemicelluloses are of arabinoxylan type, much more highly substituted than the stem xylans, and with thickening and gelling properties in solution in water, in fact filmogenic properties. The fibers of the outer part of the corn cob (hard part) are very different from those of the central or inner part (tender or soft part). The former are very hard, proportionally richer in cellulose (47%) and in lignin (7%) and less in hemicelluloses (37%), while the latter are soft, proportionally less rich in cellulose (35%) and in lignin (5%). The water-absorbent power of the soft fibers is seven times greater than that of the hard fibers.

SUMMARY OF THE INVENTION

The applicant has solved the problem of the heterogeneity of the components by treatment of the whole plant under specific conditions.

The object of the present invention is thus a process for preparing a plant-based material derived from at least one whole cereal plant comprising the following steps:

a) cutting the whole of the above-ground parts of the plant, or a major fraction of them, into fragments, b) grinding, or shearing, the fragments into granules with an average size of between about 0.01 and 10 mm, c) adjusting the water content of the granules until an overall hydration level of between 10 and 35% is achieved, and d) forming the material.

If the residual humidity level of the fragments obtained from step a) is too high, said fragments may be dried to a residual humidity level of between bout 5 and 20%. Such treatment may in particular be necessary when the plant matter is corn.

The above-ground parts of the plant should be particularly understood include the stems, leaves, cobs, grain, husks, but also any other above-ground part which may be present, as a function of the plant variety and species.

The plant matter must be derived from at least one cereal plant. It may however also comprise matter derived from one or more non-cereal plants.

The inclusion of non-above-ground parts of the plant is not particularly desired within the scope of this process, but the presence of small quantities of these non-above-ground plants does not invalidate the application of this process.

Cereal plants which may be used in the application of this process may include any cereal plant whose grain contains a sufficient quantity of starch, preferably at least 20% by weight of starch in the whole plant. They may in particular be corn, hard wheat, soft wheat, sorghum, oats, rye and rice.

One of the advantages of the present process lies in the fact that it is not necessary to perform a separation of the different parts of the plant, for example the separation of the leaves and the stem, in order to apply it. Thus, the step of cutting into fragments may be performed directly at the time of harvest, in the field.

The invention may nevertheless be applied by using either the whole of the above-ground parts of the plant which have previously been isolated, or a major fraction of these isolated above-ground parts. A major fraction should be understood as at least 80% by weight of the above-ground parts of the plant. It may also be applied by using the above-ground parts of plants belonging to different varieties or species.

By way of illustration, it is possible to use the process according to the present invention by using, as above-ground parts, wheat straw and wheat grain.

In addition, low quantities of additives may be added at any of the stages of the process, if necessary.

The above-ground parts of the plant are advantageously cut into fragments of average length between about 0.5 and 10 cm, and even more preferably between 2 and 8 cm.

This cutting may be performed by any method known to a person skilled in the art which leads to fragments of this size According to a preferred embodiment of this invention, the fragments dried in step b) to a residual humidity level of between about 7 and 13%.

This step is advantageously performed with a rotary dryer, for example a temperature of 950° C. for several minutes. However, it may also be performed by any other drying process known to a skilled person.

Step b) of grinding or shearing is preferably performed until granules of between about 0.5 and 1 mm in length are obtained. In the case of corn, a fraction of the hard part of the cob, less than about 10% by weight of the whole plant, may be discarded.

The size of the granules is measured by passing them through sieves with decreasing diameter meshes. For example, granules having a size of between about 0.5 and 1 mm pass through meshes of 1 mm in diameter but do not pass through sieves with a diameter of 0.5 mm.

The size distribution of the granules obtained by this step is advantageously the following:

between about 5 and 50% by weight of the dry matter of the granules having a size of less than about 0.25 mm, between about 5 and 40% by weight of the dry matter of the granules having a size of between about 0.25 and 0.5 mm, between about 15 and 60% by weight of the dry matter of the granules having a size of between about 0.5 and 1 mm.

between about 1 and 10% by weight of the dry matter of the granules having a size of between about 1 and 1.25 mm, between about 0,5 and 7% by weight of the dry matter of the granules having a size of between about 1.25 and 1.4, between about 1 and 10% by weight of the dry matter of the granules having a size of between about 1.4 and 1.7 mm, between about 0,1 and 10% by weight of the dry matter of the granules having a size of between about 1.7 and 2.36 mm, and between about 0 and 10% by weight of the dry matter of the granules having a size of greater than about 2.36 mm.

Step b) of grinding or shearing is preferably performed with a hammer mill fitted with sieves of appropriate mesh sizes.

However, it may also be performed by any other device known to a skilled person and giving equivalent results.

The granules produced in step b) of grinding or shearing may be immediately formed, by any method known to a person skilled in the art using filling of a mold and forming of the item under the effect of temperature and pressure, in particular by molding in an injection press.

These granules may however, after grinding or shearing and adjustment of the water content, be subjected to an extrusion step, so as to reduce the volume/mass ratio of the granules.

This extrusion step is advantageously performed in a double-screw extruder, whose screw profiles and temperature are selected by the skilled person as a function of the granules to be treated, and the desired result. The granules produced by this extrusion step may also be formed, as described above, in an injection press.

The final products, and the intermediate products of the process, are also objects of the present invention.

Thus, the present invention relates to plant matter granules with the following size distribution, the percentages being expressed by weight relative is to dry matter:

between about 5 and 50% of the granules having a size of less than about 0.25 mm, between about 5 and 40% of the granules having a size of between about 0.25 and 0.5 mm, between about 15 and 60% of the granules having a size of between about 0.5 and 1 mm.

between about 1 and 10% of the granules having a size of between about 1 and 1.25 mm, between about 0.5 and 7% of the granules having a size of between about 1.25 and 1.4 mm, between about 1 and 10% of the granules having a size of between about 1.4 and 1.7 mm, between about 0.1 and 10% of the granules having a size of between about 1.7 and 2.36 mm, and between about 0 and 10% of the granules having a size of greater than about 2.36 mm.

Such granules advantageously have percentages expressed by weight relative to dry matter:

between about 20% and 60% of starch, between about 3 and 20% of proteins, between about 15 and 60% of cellulose, hemicellulose, and lignin, between about 1 and 15% of lipids and, between about 0.01 and 10% of sugars.

These granules, optionally having been subjected to an extrusion, have a behavior comparable to that of a thermoplastic material, in other words that under the effect of temperature, they can pass from a solid state to a molten, pasty phase, and as a result can be injected into a mold and then solidify on cooling. The melting of these granules may be achieved in a plastification screw such as those used for synthetic plastics, such as polyethylene, polypropylene and polystyrene.

The final products, in other words after forming, are thus composed of granules bound together by melting of the meltable materials contained in the above-ground parts of the plants. These materials have both physicochemical and mechanical properties which distinguish them from those already described in the state of the art.

In addition, these final products are biodegradable, eco-compatible and recyclable by composting or by combustion.

A further object of the present invention is a material derived from plant matter with a tensile strength, measured according to the international standard ISO 527, of at least 10 N/mm$^2$, and preferably at least 15 N/mm$^2$, and a tension modulus of at least 1500 N/mm$^2$.

Materials according to the present invention may have a bending strength, measured as described in the standard NF EN 310, of at least 20 N/mm$^2$ and preferably at least 25 N/mm$^2$ and a bending modulus of at least 1500 N/mm$^2$.

Such materials have the following composition, the percentages being expressed in weight of dry matter, between about 20% and 60% of starch, between about 3 and 20% of proteins, between about 15 and 60% of cellulose, hemicellulose, and lignin, between about 1 and 15% of lipids and, between about 0.01 and 10% of sugars.

They may be used for packaging, or for the manufacture of calibration devices or for the manufacture of automobile interior fittings. They may be in hollow, solid or profiled shapes. These materials are workable and may be sawn, nailed, drilled and machined on a lathe. In addition, their surface is smooth, not friable, and dust-free. These materials may be glued and are compatible with surface treatments. They have in particular a good compatibility with varnishes and paints.

The present invention is illustrated without in any way being limited by the following examples.

BRIEF DESCRIPTION OF THE FIGURE

The FIGURE illustrates schematically the steps of the process which is the object of the present invention.

DETAILED DESCRIPTION OF THE INVENTION

EXAMPLE 1

Manufacture of Products According to the Invention from Corn, without Extrusion.

Whole plants of corn of variety Cécilia were harvested in October, then roughly cut up (from 1 to 5 cm). The composition of the plant matter thus obtained was the following: (% by weight of dry matter)

| Cellulose | Hemi-cellulose | Lignins | Lipids | Proteins | Starch | Sugars | Ash | Humidity |
|---|---|---|---|---|---|---|---|---|
| 17.2 | 18.6 | 1.4 | 2.7 | 6.5 | 36.1 | 5.9 | 2.6 | 10 |

The matter was dried in a rotary dryer (dehydrator: air temperature at dryer inlet: 950° C., residence time: 3 to 8 min.) to a residual humidity of 7 to 13%. It was then ground in a hammer mill fitted with two sieves of 4 and 6 mm diameter mesh.

The size distribution obtained was the following (4.3%>2.36 mm; 5.1% between 2.36 and 1.7 mm; 4.3% between 1.7 and 1.4 mm; 3% between 1.4 and 1.25 mm; 5.5% between 1.25 and 1 mm; 31.9% between 1 and 0.5 mm; 22.2% between 0.5 and 0.25 mm and 23.6% less than 0.25 mm).

The ground and dried matter was mixed with water in a planetary mixer so as to obtain a homogenous mixture with an overall hydration level (Weight of water/Total weight of wet matter) of 20%. The mixture thus obtained was formed in an injection press (temperature of the injection chamber 150° C., mold temperature 40° C., limiting pressure 70 bars, cycle length 35 s).

The formed object had:

a tensile strength characterized by an elasticity modulus of 2 365±340 N/mm$^2$ and a maximum breaking strength of 13 N/mm$^2$, for a jaw speed of 5 mm/min., and a bending strength characterized by an elasticity modulus of 2511±230 N/mm$^2$ and a breaking strength of 26±3.6 N/mm$^2$ for a speed of 0.1 mm/s.

The tensile strength test was performed according to the international standard ISO 527. The test pieces used were of type 1A and the jaw speed was 5 mm/min. (tensile test ISO 527/1A/5).

The bending strength test was a three-point test as described in standard NF EN 310. It was performed on rectangular test pieces of the following dimensions: length 60 mm, width 10 mm, thickness 4 mm. The speed of the cylindrical knife was 6 mm/min. The distance between the supports was 50 mm.

The identical tests were used in examples 2 to 4.

EXAMPLE 2

Manufacture of Products According to the Invention from Corn, with Extrusion.

Example 1 was repeated up to the grinding step, then the matter was extruded in a CLEXTRAL double-screw extruder, divided into seven zones.

The screw and temperature profiles were the following:

| Zone | Zone 1 | Zone 2 | Zone 3 | Zone 4 | Zone 5 | Zone 6 | Zone 7 |
|---|---|---|---|---|---|---|---|
| Screw type | T2F | C2F | C2F | Mal2 C2F | C2F | C2F CFC2 | C2F |
| Screw pitch | 60 60 | 33 33 | 25 25 | 10 × 10 33 | 33 33 | 25 −25 | 25 33 |
| Temperature | 14° C. | 14° C. | 15° C. | 17° C. | 15° C. | 29° C. | 24° C. |

screw T2F: trapezoid groove transfer elements
screw C2F: U groove transfer elements
screw Mal2: mixed elements (bilobal)
screw CFC2: reverse thread.

The pitch corresponding to the screw is given in mm under each element. An element measured 50 mm or 100 mm.

The water content of the matter was fixed at 20% by introduction of water into zone 2 of the extruder. The flow rate of the dry matter was 27.9 kg/h, the screw speed was 210 r.p.m. The extrusion was performed without head plate (no die), and the average residence time was 40 seconds.

The extrudate obtained had a residual humidity of 19%. It was formed in an injection press (injection chamber temperature 150° C., mold temperature 40° C., limiting injection pressure 40 bars, cycle length 35 seconds).

The formed object had:

a tensile strength characterized by an elasticity modulus of 2780±360 N/mm$^2$ and a maximum breaking strength of 16.52±2.7 N/mm$^2$, for a jaw speed of 5 mm/min., and a bending strength characterized by an elasticity modulus of 2830±215 N/mm$^2$ and a breaking strength of 35.2 N/mm$^2$ for a speed of 0.1 mm/s.

EXAMPLE 3

Manufacture of Products According to the Invention from Corn, with Grinding in a Mill Fitted with a Sieve of 2 mm Diameter Mesh.

The raw material was whole corn plants of variety Cécilia (the harvest conditions and composition are described in example 1).

The matter was dried in a rotary dryer (dehydrator: air temperature at dryer inlet: 950° C., residence time: 3 to 8 min.) to a residual humidity of 7 to 13%. It was then ground in a hammer mill fitted with a sieve of 2 mm diameter mesh.

The size distribution obtained was the following (0%>2.36 mm; 0.6% between 2.36 and 1.7 mm; 1.3% between 1.7 and 1.4 mm; 1.6% between 1.4 and 1.25 mm; 3.5% between 1.25 and 1 mm; 27.8% between 1 and 0.5 mm; 27.5% between 0.5 and 0.25 mm and 37.7% less than 0.25 mm).

The matter was extruded in a CLEXTRAL double-screw extruder. The screw and temperature profiles were the following:

| Zone | Zone 1 | Zone 2 | Zone 3 | Zone 4 | Zone 5 | Zone 6 | Zone 7 |
|---|---|---|---|---|---|---|---|
| Screw type | T2F | C2F | C2F | Mal2 C2F | C2F | C2F CFC2 | C2F |
| Screw pitch | 60 60 | 33 33 | 25 25 | 10 × 10 33 | 33 33 | 25 −25 | 25 33 |
| Temperature | 30° C. | 33° C. | 65° C. | 98° C. | 100° C. | 100° C. | 98° C. |

The water content of the matter was fixed at 25% by introduction of water into zone 2 of the extruder. The flow rate of the dry matter was 28.3 kg/h, the screw speed was 210 r.p.m. The extrusion was performed without head plate (no die), and the average residence time was 50 seconds.

The extrudate obtained had a residual humidity of 17.4%. It was formed in an injection press (injection chamber temperature 135° C., mold temperature 40° C., limiting injection pressure 150 bars, cycle length 15 seconds).

The formed object had:

a tensile strength characterized by an elasticity modulus of 3152±412 N/mm$^2$ and a maximum breaking strength of 25.8±3.2 N/mm$^2$, for a jaw speed of 5 mm/min., and a bending strength characterized by an elasticity modulus of 3428±142 N/mm$^2$ and a breaking strength of 43.4±2.8 N/mm$^2$ for a speed of 0.1 mm/s.

The water absorption after immersion of the object for one hour at ambient temperature was 40%. The breaking time of the object subjected to static tension (24 Newtons) under immersion was 5 hours.

EXAMPLE 4

Manufacture of Products According to the Invention from Wheat.

The raw material was whole wheat plants harvested and cut up so that the straw had a particle size of less than 5 mm and that the grain was whole.

Its composition was the following:

| Cellulose Hemicelluloses Lignins | Lipids | Proteins | Starch | Sugars | Ash | Humidity |
|---|---|---|---|---|---|---|
| ---38--- | 1,4 | 7,2 | 46,8 | 0,1 | 2 | 91,3 |

(% by weight of dry matter).

The matter was extruded in a CLEXTRAL double-screw extruder. The screw and temperature profiles were the following:

| Zone | Zone 1 | Zone 2 | Zone 3 | Zone 4 | Zone 5 | Zone 6 | Zone 7 |
|---|---|---|---|---|---|---|---|
| Screw type | T2F | C2F | C2F | Mal2 C2F | C2F | C2F CFC2 | C2F |
| Screw pitch | 60 60 | 33 33 | 25 25 | 10 × 10 33 | 33 33 | 25 −25 | 25 33 |
| Temperature | 25° C. | 26° C. | 64° C. | 85° C. | 83° C. | 89° C. | 90° C. |

The water content of the matter was fixed at 25% by introduction of water into zone 2 of the extruder. The flow rate of the dry matter was 40.5 kg/h, the screw speed was 210 r.p.m. The extrusion was performed without head plate (no die).

The extrudate obtained had a residual humidity of 14.2%. It was formed in an injection press (injection chamber temperature 127° C., mold temperature 30° C., limiting injection pressure 150 bars, cycle length 15 seconds).

The formed object had:

a tensile strength characterized by an elasticity modulus of 3411±224 N/mm$^2$ and a maximum breaking strength of 29.1±1.6 N/mm$^2$, for a jaw speed of 5 mm/min., and a bending strength characterized by an elasticity modulus of 4027±586 N/mm$^2$ and a breaking strength of 60.1±4.1 N/mm$^2$ for a speed of 0.1 mm/s.

The water absorption after immersion of the object for one hour at ambient temperature was 46%. The breaking time of the object subjected to static tension (24 Newtons) under immersion was 9 hours.

What is claimed is:

1. A material formed from plant matter granules wherein said plant matter granules possess the following size distribution, the percentages being expressed by weight of dry matter:

between about 5 and 50% of the granules having a size of less than about 0.25 mm, between about 5 and 40% of the granules having a size of between about 0.25 and 0.5 mm, between about 15 and 60% of the granules having a size of between about 0.5 and 1 mm, between about 1 and 10% of the granules having a size of between about 1 and 1.25 mm, between about 0.5 and 7% of the granules having a size of between about 1.25 and 1.4 mm, between about 1 and 10% of the granules having a size of between about 1.4 and 1.7 mm, between about 0.1 and 10% of the granules having a size of between about 1.7 and 2.36 mm, and between about 0 and 10% of the granules having a size greater than about 2.36 mm.

2. The material of claim 1 which possesses a tensile strength of at least 10 N/mm$^2$ and a tension modulus of at least 1500 N/mm$^2$.

3. The material of claim 1 which possesses a bending strength of at least 20 N/mm$^2$ and a bending modulus of at least 1500 N/mm$^2$.

4. The material according to claim 1, wherein said material has the following composition, the percentages being expressed in weight of dry matter:

between about 20% and 60% of starch, between about 3 and 20% of proteins, between about 15 and 60% of the total of cellulose, hemicellulose and lignin, between about 1 and 15% of lipids and, between about 0.01 and 10% of sugars.

5. The material according to claim 1 which is in form of hollow, solid or profiled shapes.

* * * * *